United States Patent [19]

Morlan

[11] 4,023,884

[45] May 17, 1977

[54] AUXILIARY TERMINAL FOR CARTRIDGE FUSES

[76] Inventor: Marcus L. Morlan, R.D. No. 1, Box 27, Richmond, Ohio 43944

[22] Filed: Aug. 27, 1975

[21] Appl. No.: 608,066

[52] U.S. Cl. ..... 339/258 F
[51] Int. Cl.² ..... H01R 11/22
[58] Field of Search ..... 339/244 R, 258 F

[56] References Cited

UNITED STATES PATENTS 3,478,307 11/1969 Testo ..... 339/258 F

FOREIGN PATENTS OR APPLICATIONS 582,677 11/1946 United Kingdom ..... 339/258 F
633,299 12/1949 United Kingdom ..... 339/258 F

*Primary Examiner*—Roy Lake
*Assistant Examiner*—Mark S. Bicks
*Attorney, Agent, or Firm*—W. Preston Hickey

[57] ABSTRACT

Means for providing a terminal to existing cartridge fuse installations. The preferred means is a clip comprising a split cylinder which fits between one end of a cartridge fuse and its holder and which contains a terminal extending at right angles to the split cylinder. In another embodiment the terminal which extends at right angles to the fuse is made as an integral part of the end cap of a cartridge fuse.

1 Claim, 4 Drawing Figures

AUXILIARY TERMINAL FOR CARTRIDGE FUSES

BACKGROUND OF THE INVENTION

Cartridge fuses have been made and used almost since the beginning of the electrical industry. They were adopted and used almost from the start of the commercial production of radios, and they were used almost from the start of the commercial production of automotive vehicles. A cartridge fuse panel has been installed in practically every automobile that has ever been made. In the interest of economy, the fuses are grouped together in panels which contain no more fuses or fuse holders than is contemplated to supply electricity for the original equipment that is installed on the vehicle, and the fuse connections that are provided will not accommodate anymore connections. The result is that when it is desired to add an electrical device to an existing fuse panel, the installer finds that there are no unused fuse terminals to which an electrical connection can be made for the new installation. In those installations where the wires are soldered to the terminals, it is most difficult, and certainly most inconvenient, to try to melt some of the solder away, and insert another wire through the opening in the terminal which contains the existing wiring. The result is that the installer will usually lay the wire on top of the terminal and solder it in place without first making a mechanical connection; or he will cut the wire and splice the new wire thereto using a wire nut. A wire nut is bulky and can be pulled off, so that it does not make for a neat and failure-proof installation. For those installations where the fuse holders are provided with spade terminals there is no way of adding a second female spade terminal to the existing terminals; and in such cases, either a splice is made to the wire coming therefrom, or an attempt is made to wedge the wire between the male and female spade terminals. It can readily be seen that such an arrangement does not securely attach the wire in place and a separation and loss of power to the appliance can occur at some further time. A need has clearly existed for at least 50 years for a better way of adding a wire to existing cartridge fuse holders.

An object of the present invention, therefore, is the provision of a new and improved means for attaching a wire to an existing cartridge fuse installation.

Another object of the present invention is the provision of a new and improved clip which can be added to any cartridge fuse to provide a new terminal connection.

A futher object of the invention is the provision of a new and improved cartridge fuse that can be added to existing installations, and which will provide an addition electrical terminal.

Further objects and advantages of the invention will become apparent to those skilled in the art the which the invention relates from the following description of the preferred embodiments which are described with reference to the accompanying drawings forming a part of this specification.

DESCRIPTION OF THE PREFERRED EMBODIMENTS

It will be understood that the usual fuse block in an automotive vehicle as well as in other electrical installations will usually contain a multiplicity of cartridge fuses that are located in a parallel side-by-side arrangement with substantially no working space between the fuses, and in many instances, with the individual fuses being positioned in rectangular recesses to provide a wall of insulating material to separate them. It is in this type of installation that the present invention has its greatest advantages. In order to show the invention more clearly, however, it is shown in conjunction with a single cartridge fuse that is received in the usual pair of cartridge clips, in order that the electrical connections can better be seen.

Figure 1:
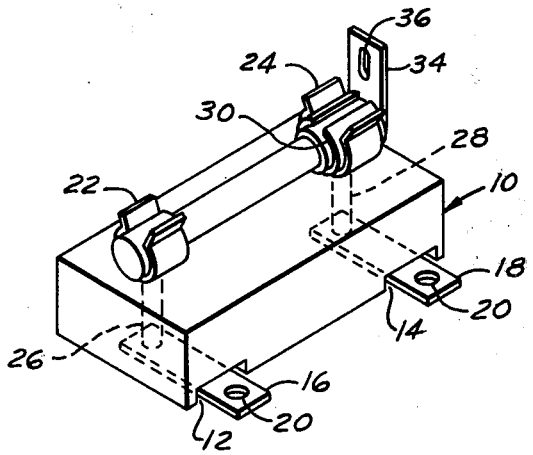
FIG. 1 is an isometric view showing an insulator block containing a pair of cartridge fuse holders in which is received both a cartridge fuse, and a terminal clip embodying principles of the present invention.

The cartridge fuse assembly shown in FIG. 1 generally comprises an insulator block 10 having front and rear rectangular recesses 12 and 14, respectively, extending laterally across the bottom of the insulator block 10. Front and rear electrical terminal strips 16 and 18 are positioned in the recesses 12 and 14, respectively, and the projecting ends of each terminal strip contains an oblong opening 20 for receiving the hooked ends of electrical wires and thereby provide a mechanical connection before the wire is soldered to the terminal. Identical front and rear U-shaped fuse clips 22 and 24, respectively, are positioned on the top surface of the fuse block directly above the respective front and rear terminal strips with the front fuse clip being riveted to the front terminal strip 16 by a copper rivet 26, and the rear fuse clip 24 being connected to the rear terminal strip 18 by a copper rivet 28. The copper rivets 26 and 28 not only hold the fuse terminal strips in position on the insulator block 10 but they also provide an electrical connection between the respective clip and the respective terminal strip. It will be understood that the front and rear fuse clips 22 and 24 can be variously shaped, so long as they will mechanically retain the end of a cartridge fuse therein, and at the same time make an electrical connection between the clip and cartridge fuse. It will be understood that cartridge fuses contain spaced apart electrically conductive caps on their opposite ends which are held spaced apart by an insulating material, as for example, a tube of glass. Inside of the insulator tube is a fusible link that provide electrical continuity between the opposite end caps. The clips 22 and 24 that are shown in the drawing are of the most commonly used type and have a short flat bottom for receiving the support rivet, and have opposite arcuate side portions which are spaced apart by a distance less than the diameter of the cartridge cap. The upper side portions of the clip are bent outwardly to provide cams which will cause the sides of the clip to spring outwardly when a fuse is pressed downwardly between the sides of the clip. The clips are usually made of a spring material which will accommodate the necessary movement without undergoing a permanent deformation, but even when permanent deformation occurs, the projecting sides of the clip can be bent together again to increase the gripping action on the cartridge fuse.

Figure 2:
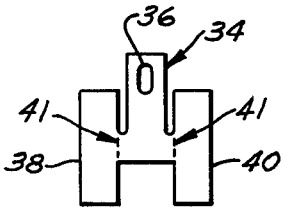
FIG. 2 is a plan view of a flat metal blank that is used to make the terminal clip shown in FIG. 1.
Figure 3:
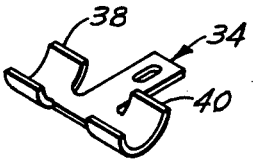
FIG. 3 is an isometric view showing the terminal blank of FIG. 2 in a second stage of production wherein each of the and lateral legs are bent into a semicylindrical shape.
Figure 4:
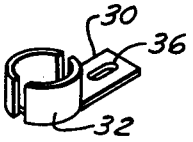
FIG. 4 shows the terminal clip of FIG. 3 with each of the semicylindrical portions bent 90 degrees to face each other, and with the center terminal portion extending upwardly at right angles to complete the clip.

According to the present invention an auxiliary terminal clip 30 is provided which is first slid endwise onto an end cap of a cartridge fuse before the fuse is pushed downwardly into position between the sides of the fuse clip. As shown in FIG. 1, the auxiliary terminal clip 30 is positioned on the rear end cap of the fuse between the side legs of the rear fuse clip 24. The auxiliary terminal 30 is best seen in FIG. 4, and comprises a slit cylinder 32 which clamps onto the cap of a cartridge fuse, and a terminal strip portion 34 which extends across the end at right angles to the slit cylinder portion 32. In the embodiment shown, the terminal strip portion 34 is one-fourth inch wide and rectangularly shaped for receiving spade terminals, and also contains an oblong opening 36 for receiving the ends of electrical wire in well known fashion. The auxiliary terminal can be made from a generally H-shaped blank as best seen in FIG. 2. The lateral portion 38 and 40 of the H-shaped blank can be bent about a suitable mandrel into semicylindrical shapes having an inside diameter slightly less than that of the end cap of the cartridge fuse in which it is received as shown in FIG. 3. Thereafter the semicylindrical lateral portions 38 and 40 are bent towards each other along the folds 41 to complete the split cylinder 32, leaving the terminal portion 34 extending at right angles thereto to complete the formation of the auxiliary terminal 30.

According to principles of the invention it has been observed that there will almost always be clearance in the area immediately adjacent, and outwardly of, the fuse clips in most installations, and which will accommodate the terminal strip 34, so that the present invention will provide a convenient means for adding a electrical connection to existing fuse installations in practically all instances.

While the invention has been described in considerable detail, I do not wish to be limited to the particular embodiments shown and described; and it is my intention to cover hereby all nove adaptations, modifications and arrangements thereof which will come to those skilled in the art to which the invention relates, and which fall within the purview of the following claims.

I claim:

1. An end cap terminal for cylindrical cartridge fuses and which is developed from a generally H-shaped blank having generally parallel vertical legs, a horizontal connecting section and a generally vertical terminal strip on said connecting section between said legs, said legs being bent concavely upwardly, and each opposite end of said connecting section being bent at a generally right angle to bring said concave legs in facing relationship with each other, and whereby said concavely bent legs will surround the cap of a cylindrical cartridge fuse with the vertical terminal strip being positioned against the end of the fuse.

* * * * *